US005386451A

United States Patent [19]

Hansen

[11] Patent Number: 5,386,451

[45] Date of Patent: Jan. 31, 1995

[54] ANODE POTENTIAL STATOR DESIGN

[75] Inventor: Steven D. Hansen, Port Washington, Wis.

[73] Assignee: General Electric Company, Milwaukee, Wis.

[21] Appl. No.: 113,009

[22] Filed: Aug. 30, 1993

[51] Int. Cl.[6] ..... H01J 35/10

[52] U.S. Cl. ..... 378/131; 378/125

[58] Field of Search ..... 378/131, 119, 125, 132; 370/68 R, 166

[56] References Cited

U.S. PATENT DOCUMENTS 4,024,424 5/1977 Eggelsmann et al. ..... 378/93
4,115,718 9/1978 Eggelsmann ..... 378/125
4,360,734 11/1982 Dietz et al. ..... 378/93
4,679,220 7/1987 Ono ..... 378/132
4,811,375 3/1989 Klostermann ..... 378/131

*Primary Examiner*—David P. Porta
*Assistant Examiner*—Don Wong
*Attorney, Agent, or Firm*—B. Joan Haushalter; John H. Pilarski

[57] ABSTRACT

The motor efficiency of a rotating X-ray tube having an anode assembly and a cathode assembly, can be greatly improved. The improved efficiency x-ray tube motor comprises a stator and rotor assembly having an air gap between the stator and rotor. The improved efficiency is achieved by reducing the air gap. The stator is operated at anode potential and electrically connected through an anode high voltage cable.

3 Claims, 2 Drawing Sheets

ANODE POTENTIAL STATOR DESIGN

TECHNICAL FIELD

The present invention relates to rotating X-ray tubes and, more particularly, to rotating X-ray tubes which employ a rotating anode assembly and cathode assembly operated at equal potential and opposite polarity.

BACKGROUND ART

X-ray tubes used in medical diagnostic imaging are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

Such an arrangement is typical of rotating X-ray tubes and has remained relatively unchanged in concept of operation since its introduction. Unfortunately, this type of motor arrangement with the combined stator and rotor is very inefficient. For example, in low speed steady state operation, where the rotor is driven with a frequency of 3600 rotations per minute (RPM), the peak motor efficiency is only approximately 8% and the average motor efficiency is only approximately 4.5%. In high speed steady state operation, where the rotor is driven with a frequency of 10,800 RPM, the peak motor efficiency is approximately 24% and the average motor efficiency is approximately 12%. The poor efficiency of the current motor design results in low torque delivered to the rotor assembly and a large amount of heat (typically 300–400 Watts in the run mode of operation) delivered to the tube housing environment.

The low efficiency of the existing design results from the need to employ a significant air gap between the rotor assembly and stator due to the differences in potential. As the stator operates at or near ground potential and the anode may be raised to 75,000 VDC positive with respect to ground, a large air gap on the order of 0.400 inches or greater is needed to maintain stable, discharge free operation in the current design techniques.

Several attempts have been made to improve the efficiency of the stator through other design techniques, such as increasing the length of the stator core and varying the material in the stator core. Unfortunately, such attempts have resulted in, at best, only incremental improvements in delivered torque to the rotor. For instance, a 40% increase in stator core length yields only a 25% improvement in delivered torque to the rotor assembly during steady state run operation. Also, it has been found that variations in the core material have little to no significant effect.

It would be desirable then to have a design which improves the efficiency of the stator and rotor assembly.

SUMMARY OF THE INVENTION

The present invention provides a design which improves the efficiency of the stator and rotor assembly by decreasing the length of the air gap between the stator and rotor. This decrease in the air gap greatly increases the quantity of magnetic flux in the magnetic circuit and results in a significant increase in rotor torque. The small air gap necessitates equal potential between the anode assembly and stator so as to prevent high voltage instability during operation. Consequently, either the anode may be run at ground potential or the stator may be operated at the anode assembly potential. In a preferred embodiment, it is desired to operate the stator at high potential, as that allows the improved small air gap stator design to be incorporated into existing X-ray diagnostic systems.

In accordance with one aspect of the present invention, the efficiency of a rotating X-ray tube having an anode assembly and a cathode assembly, can be greatly improved. The improved efficiency x-ray tube comprises a stator and rotor assembly having an air gap between the stator and rotor. The improved efficiency is achieved by reducing the air gap.

Accordingly, it is an object of the present invention to improve the efficiency of the stator and rotor assembly of a rotating X-ray tube. Other objects and advantages of the invention will be apparent from the following description, the accompanying drawings and the appended claims.

DETAILED DESCRIPTION OF THE PREFERRED EMBODIMENTS

The present invention relates to rotating X-ray tubes which employ a rotating anode assembly and cathode assembly operated at equal potential but opposite polarity. The efficiency and resulting torque of the stator can be greatly increased by reducing the typical stator air gap and operating the stator at anode potential. Hence, the present invention provides a means for improving the efficiency of the stator and rotor assembly by decreasing the length of the air gap between the stator and rotor and operating the stator at a node potential. This, in turn, greatly increases the quantity of magnetic flux in the magnetic circuit and results in a significant increase in rotor torque.

Figure 1:
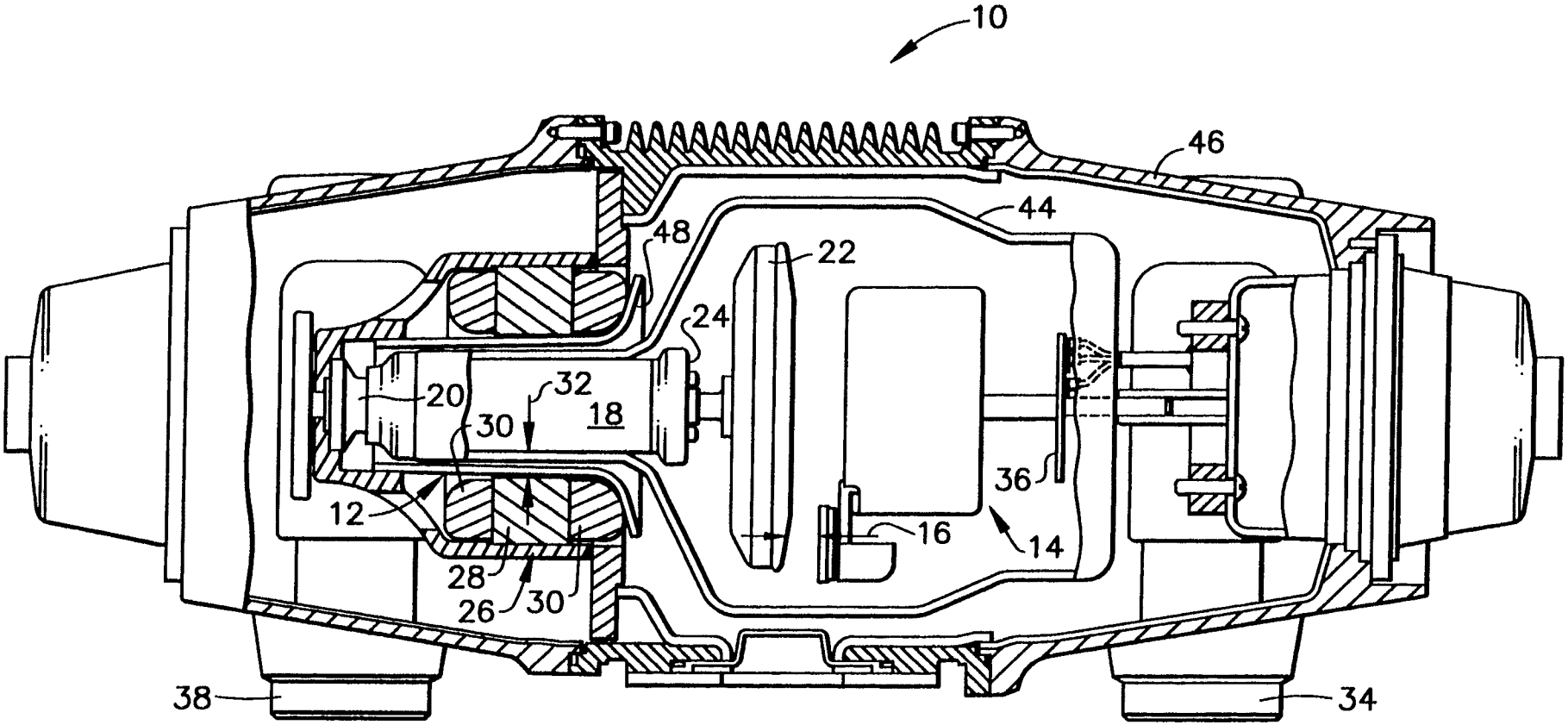
FIG. 1 (PRIOR ART)
FIG. 1 is a prior art cross-sectional illustration of a typical X-ray tube.

Referring now to the drawings, FIG. 1 illustrates a typical prior art X-ray tube 10. The X-ray tube 10 is typically built with a rotating anode assembly 12 for the purpose of distributing the heat generated at a focal spot, and an X-ray tube cathode assembly 14 for providing a focused electron beam which is accelerated across a large anode-to-cathode vacuum gap 16 and produces X-rays upon impact with the anode.

Continuing with FIG. 1, the anode assembly 12 is rotated by an induction motor comprising a cylindrical rotor 18 built around a cantilevered axle 20. The cantilevered axle 20 supports a disc shaped anode target 22 connected via the hub and stud 24 to rotor 18 and cantilevered axle 20 which contains bearings facilitating rotation. The stator 26 of the induction motor includes an iron stator core 28 with copper windings 30 that surround the rotor 18. The rotor 18 of the rotating anode assembly 12, driven by the stator 26, is at anodic potential while the stator is referenced electrically to ground. Since the stator 26 operates at or near ground potential and the anode may be raised to 75,000 VDC positive with respect to ground, a large air gap 32, typically on the order of 0.400 inches or greater, is needed to maintain stable, discharge free operation.

Figure 2:
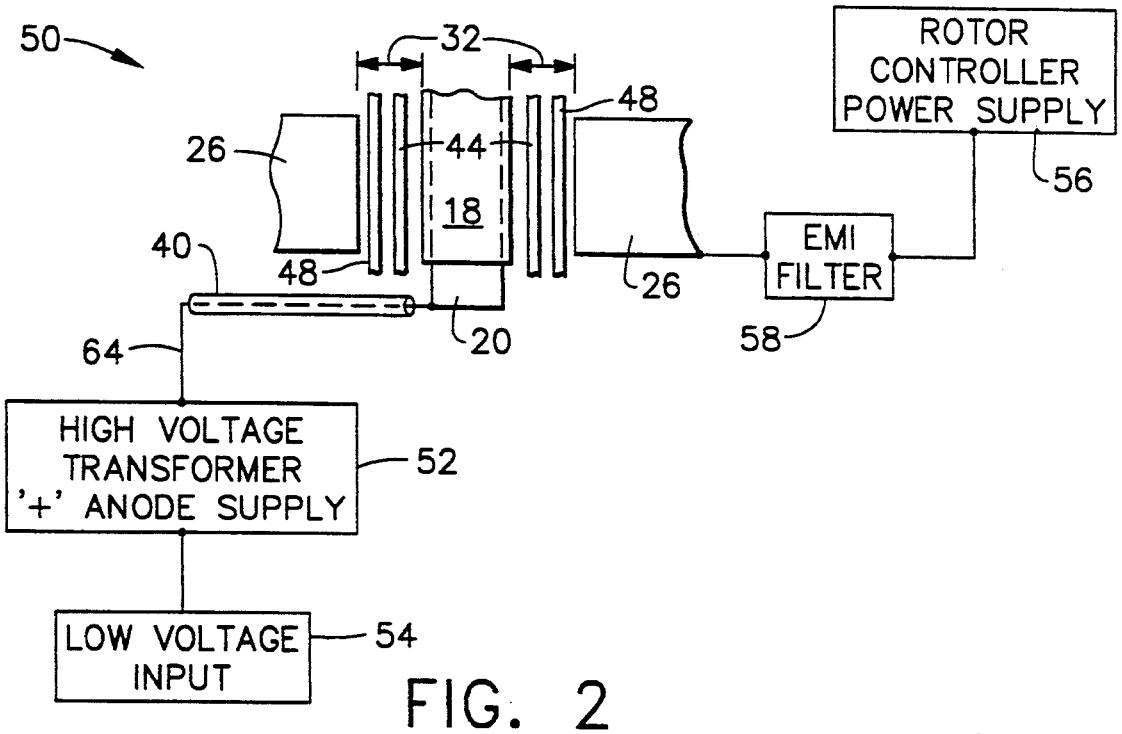
FIG. 2 (PRIOR ART)
FIG. 2 is a prior art schematic block diagram of a typical X-ray tube design.
Figure 3:
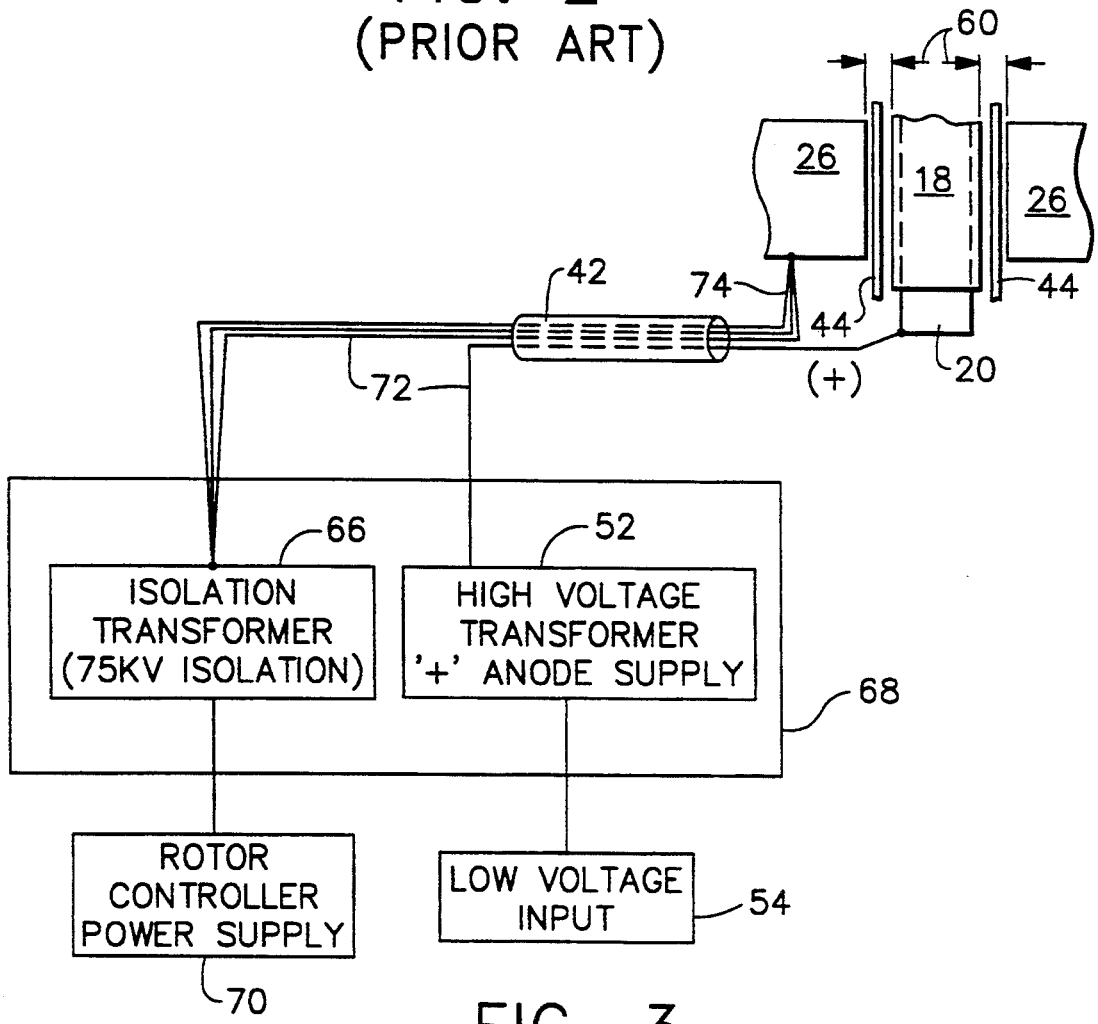
FIG. 3 is a schematic block diagram of an X-ray tube in accordance with the present invention.

Continuing with FIG. 1, the X-ray tube cathode assembly 14 includes a cathode cable receptacle 34 and a cathode terminal board 36 which internally connects the cathode assembly 14 to the receptacle 34. The anode assembly 12 includes an anode cable receptacle 38 which electrically connects the anode to an anode high voltage cable 40 or 42, as shown in FIGS. 2 and 3, respectively. In a typical assembly, the anode assembly 12 and the cathode assembly 14 are sealed in a glass frame 44 and mounted in a conductive metal housing 46. Finally, an insulation material 48 is provided between the stator 26, and the glass frame 44 and rotor 18.

Referring now to FIG. 2, a prior art side view schematic block diagram 50 of a typical X-ray tube design is illustrated. The block diagram 50 includes a high voltage transformer positive anode supply 52 receiving a low voltage input 54. The X-ray tube shown in FIG. 2 further includes a rotor controller power supply 56 associated with an EMI filter 58 for filtering electromagnetic noise before the noise from the stator 26 can affect the controller 56. The stator 26 surrounds rotor 18, connected to the high voltage transformer positive anode supply 52 via anode high voltage cable 40 and the cantilevered axle 20.

The low efficiency of the design illustrated in FIG. 2 results from the need to employ the significant air gap 32 between the rotor 18 and the stator 26, due to the differences in potential. The air gap 32 is usually filled with various insulating materials 48, and/or the glass frame 44. As stated, since the stator 26 operates at or near ground potential and the anode may be raised to 75,000 VDC positive with respect to ground, the air gap 32 is required to be quite large, on the order of 0.400 inches or greater, to maintain stable, discharge free operation.

Referring now to FIG. 3, the present invention provides for a significant decrease in the air gap 32 of FIGS. 1 and 2, resulting in the decreased air gap 60 of FIG. 3, which greatly increases the efficiency and resulting torque of the stator 26. In the system of the present invention, the air gap 60 has been reduced to approximately 0.050 inches. The length of the stator air gap has been decreased from a typical air gap and is approximately that of typical fractional horsepower induction motors. Through the reduction of the air gap, the efficiency of the stator 26 can be greatly increased from the 4% average low speed and 12% average high speed, to speeds typically seen in conventional fractional horsepower induction motor design of 70% and greater. The insulating material 48 is eliminated in FIG. 3. Operating the stator and anode at the same potential, i.e., the anode potential, eliminates the need for the insulating material 48.

With the decrease in the air gap length to the new air gap 60 of FIG. 3, the torque delivered to the anode assembly 12 through the rotor 18 can be significantly increased. This allows consistent rotation of large targets 22, as in FIG. 1, comprising metal and composite metal/graphite with heat storage of several million heat units needed in high throughput applications, such as helical CT scanning and vascular examinations. As the efficiency of the stator 26 improves, the amount of waste energy deposited as heat in the housing environment 46 of the tube 10 is greatly reduced. Since tube housing heat storage can be an operational limitation, the heat energy subtracted from the available heat storage of the casing is an advantage of the present invention.

Furthermore, due to the efficiency improvement of stator and rotor combination illustrated in FIG. 3, the size of the rotor controller can be greatly reduced. This is of particular importance when considering the size and weight restrictions required on a slip ring gantry rotating at one revolution per second or greater, in CT technology.

Continuing with FIG. 3, the stator 26 is powered through the anode high voltage cable 42 and is referenced to the applied anode potential. The anode high voltage cable 42 is identical to the cathode high voltage cable (not shown). In the prior art, as shown in FIG. 2, the typical anode high voltage cable 40 uses only one available lead 64, of which there are usually three or four, of the cable, while the unused leads are shorted together and not used.

In the present invention illustrated in FIG. 3, however, isolation transformers 66 are located in an anode high voltage transformer tank 68, along with the high voltage transformer positive anode supply 52. The isolation transformers 66 are typically on the order of 75,000 volts. In this respect, the anode transformer tank 68 can be made identical to the cathode high voltage tank (not shown), which has isolation transformers for the filament drives. Use of common cathode and anode tanks reduces manufacturing costs, since the tanks are identical and only the actual electronics which provide either negative or positive potential are different.

Continuing with FIG. 3, a rotor controller power supply 70 inputs power to the primary winding of isolation transformers 66 in the transformer tank 68. The rotor controller power supply input power is referenced to ground potential. The secondary windings of the isolation transformers are then referenced to anode potential via connection lines 72, and the output power is routed to the high voltage cable 42. The output power is transmitted through the high voltage cable 42 and electrically connected via connection 74 to the stator 26 through a terminal board on the anode, similar to the manner in which cathode connections are currently made on the cathode terminal board. The high voltage transformer positive anode supply 52 receives the low voltage input 54.

In accordance with the present invention, the air gap 60 is decreased by operating the stator 26 at the anodic potential. The stator is electrically connected to the rotor controller through the high voltage anode cable 42 and the isolation transformer 66 in the anode transformer tank 68.

It will be obvious to those skilled in the art that various modifications and variations of the present invention are possible without departing from the scope of the invention, which provides a decrease in the length of the air gap between the stator and rotor, thereby greatly increasing the quantity of magnetic flux and resulting in a significant increase in rotor torque.

The invention has been described in detail with particular reference to certain preferred embodiments thereof, but it will be understood that modifications and variations can be effected within the spirit and scope of the invention.

We claim:

1. A rotating X-ray tube having an anode assembly and a cathode assembly, the x-ray tube comprising:

a stator and rotor assembly having an air gap between the stator and rotor;

means for operating the stator at anode potential to improve efficiency of the stator and rotor assembly by reducing the air gap to a length of approximately 0.050 inches.

2. A rotating X-ray tube as claimed in claim 1 further comprising means for operating the anode assembly and the cathode assembly at equal potential and opposite polarity.

3. A rotating X-ray tube as claimed in claim 1 wherein the stator is electrically driven through an anode high voltage cable.

* * * * *